US006217124B1

(12) United States Patent
Jespersen

(10) Patent No.: US 6,217,124 B1
(45) Date of Patent: Apr. 17, 2001

(54) METHOD FOR MANUFACTURING A SWEEPER OR ABRASIVE ELEMENT AND SUCH ELEMENT

(76) Inventor: Poul Erik Jespersen, Lyngvænget 6, DK-7870 Glyngøre (DK)

( * ) Notice: Subject to any disclaimer, the term of this patent is extended or adjusted under 35 U.S.C. 154(b) by 0 days.

(21) Appl. No.: 09/155,207

(22) PCT Filed: Mar. 26, 1997

(86) PCT No.: PCT/DK97/00140

§ 371 Date: Sep. 24, 1998

§ 102(e) Date: Sep. 24, 1998

(87) PCT Pub. No.: WO97/35688

PCT Pub. Date: Oct. 2, 1997

(30) Foreign Application Priority Data

Mar. 26, 1996 (DK) ..... 0345/96

(51) Int. Cl.[7] ..... A46B 3/02; A46D 3/04

(52) U.S. Cl. ..... 300/21; 300/21; 15/179; 15/182; 15/183; 451/490; 451/533

(58) Field of Search ..... 300/21; 15/179, 15/181, 190, 183, 193, 195, 198, 230.12, 182; 451/353, 490, 533; 51/298

(56) References Cited

U.S. PATENT DOCUMENTS 2,400,809 * 5/1946 Cave ..... 300/21
2,845,648 * 8/1958 Peterson ..... 15/193
4,998,316 * 3/1991 Maltarp ..... 15/193
5,358,311 * 10/1994 Drumm .
5,400,458 * 3/1995 Rambosek .
5,762,404 * 6/1998 Drumm ..... 300/21

FOREIGN PATENT DOCUMENTS 29 09 638 A1 * 9/1980 (DE) .
171364 B1 * 8/1992 (DK) .
849/92 * 12/1993 (DK) .
171703 B1 * 4/1997 (DK) .

* cited by examiner

*Primary Examiner*—Robert J. Warden, Sr.
*Assistant Examiner*—Kaj K. Olsen
(74) *Attorney, Agent, or Firm*—James Creighton Wray; Meera P. Narasimhan

(57) ABSTRACT

A method for manufacturing a sweeper or abrasive element is disclosed. The abrasive element is manufactured from a U-shaped plastic profile having an aperture in which are placed abrasive lamellae, supporting bristles and heat-dissoluble plastic threads. By heating above the plasticization temperature of the plastic, total embedding of the bristles and abrasive lamellae occurs thereby forming an integral unit. This ensures that the bristles and/or abrasive lamellae will not separate during use of rotating abrasive or polishing tools in which the abrasive elements are included. As the abrasive elements are of plastic material they are flexible and able to adapt to different diameters of abrasive or polishing tools. The user, therefore, only needs to have a supply of abrasive elements, cut into suitable lengths depending on the diameter of the tool in which the abrasive elements are to be replaced.

10 Claims, 2 Drawing Sheets

METHOD FOR MANUFACTURING A SWEEPER OR ABRASIVE ELEMENT AND SUCH ELEMENT

BACKGROUND OF THE INVENTION

The present invention relates to a method for manufacturing a sweeper or abrasive element for use in a rotating sweeper, abrasive or polishing tool and comprising bristles or lamellae of abrasive cloth and rigidifying bristles, which are retained in a substantially U-shaped profile.

The invention has originated in the context of manufacturing rotating abrasive and polishing tools. However, the invention may also advantageously be used in the context of sweeper tools such as known, e.g. from brushes mounted on tractors or from other rotating brushes where the sweeper brushes are generally embedded for squeezing in a metal U profile. As the invention primarily originates from the context of abrasive or polishing tools, the following explanation will mainly be based on the disadvantages associated with such tools and, likewise, the advantages of the invention will also primarily be explained in the context of such tools.

Rotating abrasive or polishing tools provided with abrasive elements are known. Such tools are used extensively in the woodworking industry.

Abrasive elements of the type comprising abrasive cloth and rigidifying bristles have obtained widespread use as they give a good result when grinding profiled wooden items.

Abrasive or polishing tools of the type in which the abrasive element is used have so far primarily been used for grinding and polishing non-plane surfaces such as curved furniture parts, panelled doors, etc. The lamellae of the abrasive element are formed by cutting an abrasive cloth transversely of its longitudinal direction so that strips or lamellae appear, which are at one end interconnected by means of an unbroken tape secured to the U profile. The abrasive or polishing effect is obtained as a result of the effect of the lamellae as they sweep over the item during rotation of the tool. The rigidifying brushes, as indicated by the word, have a function of supporting the abrasive lamellae. However, the brushes may also be produced from such a material that they contribute to the abrasive or polishing effect.

A known tool of this type is designated "Flatter polisher". Abrasive or polishing tools of this type are disclosed, e.g. in Danish patent applications No. 191/91 and No. 849/92. These applications also disclose abrasive elements of the type mentioned in the introduction.

Such tools are formed by a number of circular or helical abrasive elements arranged in parallel. The abrasive elements are arranged in a track in a cylinder shell so that a cylindrical abrasive or polishing tool is formed, which has an abrasive or polishing effect from its cylindrical circumference.

The abrasive or polishing effect of the tools appears as a result of the effect of the lamellae during the flexible sweeping of the item during rotation of the tool. During rotation of the tool, merely the centrifugal force will contribute to the abrasive or polishing pressure necessary for the treatment. Furthermore, the rigidity of the lamellae themselves will be important in order to produce the necessary abrasive or polishing pressure. Furthermore, the supporting brushes inserted next to the lamellae will also serve to increase the abrasive pressure of the lamellae, and the brushes may be produced from a material contributing to the abrasive or polishing process.

Polishing, i.e. grinding and inter-paint polishing of wood, is performed in order to obtain the best possible surface quality. Polishing items that are profiled, or which have a complex shape, make heavy requirements on the polishing technique used. The polishing tools and their polishing or abrasive elements must necessarily be very flexible and must be able to adapt to items to be polished in order to ensure a uniform treatment of the surface. Thus, there must be no grinding of edges, and it also has to be ensured that polishing or grinding is established in grooves and adjacent projections.

In these known abrasive elements, the lamellae and the brushes are placed in a U-shaped metal profile, which is subsequently squeezed together around the abrasive lamellae and the brushes. Squeezing of the U profile is performed in such a manner that brushes and lamellae are retained mechanically in the profile. Retention might be improved by means of a metal wire or plastic wire inserted in the U bottom. Said wire increases the cross-section area under the squeezed sides of the U profile. This improves retention as the brushes and possibly also part of the lamellae are folded around the wire. In squeezing the U profile, it is simultaneously given a cross-section shape fitting into undercut tracks in the abrasive or polishing tool.

Although the known abrasive elements have proven advantageous as they are easy to replace, they have been associated with certain disadvantages. They have not been so flexible as has been desirable since the mechanical deformation of the U profiles, produced from metal, might cause difficulties in adapting the abrasive elements to different types of tools and especially to tools of different diameters. Thus, it has been necessary to produce the abrasive elements for each particular tool.

The known abrasive elements have furthermore turned out to be disadvantageous in that they lose some of the bristles and/or lamellae after use for some time.

It is the object of the invention to provide a method for manufacturing a sweeper or abrasive element and to disclose the actual sweeper or abrasive element, which is not associated with the disadvantages of the known elements, and which is ready for use directly upon manufacture.

This is obtained according to the present invention by a method that is characterised in that a plastic profile is provided having a bottom and two legs projecting upward from it, which is manufactured in a compressed state so that the legs are elastically yielding pressed towards each other, so that the profile has a substantially triangular longitudinal cross-section in an initial state, and which is flexible in the longitudinal direction according to a plan perpendicular to the U bottom, that said profile is advanced, that the two U legs are spread, and that between them bristles are inserted between the two legs, or abrasive lamellae are inserted adjacent a first one of the two U legs and rigidifying bristles adjacent the second leg, that in the bottom of the U an adhesive member for gluing the bristles or the bristles and abrasive lamellae is inserted, that the U profile is brought back to its point of origin, the upper ends of the two legs approaching each other and thus squeezing the bristles or the lamellae and rigidifying bristles, and that the element formed is cut into desired lengths for use.

With this method it becomes possible to manufacture sweeper or abrasive elements such that the sweeper bristles or the rigidifying bristles and lamellae will not become loose during use. Thus, the adhesive member will ensure adhering of the bristles to the U profile. The profile may be manufactured in endless lengths by continuous conveyance of the U-shaped profile into which bristls and lamellae are inserted. After adherence and a deformation of the U profile have taken place, the latter may be cut into desired lengths without any risk that the outermost lamellae and bristles in the cut lengths of the abrasive element would fall out or become loose during use. Consequently, the U-shaped profile may be cut into any arbitrary length required for a given abrasive or polishing tool.

The U-shaped profile may easily be adapted to the tool and will also be able to be adapted to any diameter of the tool since the U-shaped profile is made flexible in the plane perpendicular to the bottom of the U.

A flexible U-shaped plastic profile is used in which the distance between the upper ends of the U legs in a non-deformed state is shorter than the distance between the lower ends of the U legs. This means in other words that a plastic profile is used in which the legs themselves have an elastic force towards each other in order to squeeze around the brushes and lamellae placed between the U legs. For this method it is preferred for the adhesive member to be a fusible plastic thread. Thus, it will be possible to deform both the U profile and the plastic thread during heating. Heating may take place thermally or by ultrasound. By the obtained plasticisation of the plastic it will be possible to embed the brushes and the lamellae in the plastic so that an integral unit results. This may be accomplished in a suitable manner by conducting the U profile with the brushes and lamellae arranged therein through a matrix. During a subsequent cooling the plastic profile may, by means of a suitably shaped matrix, be given a desired outer contour. This will frequently be a cross-section shape making it possible to place the abrasive element in a dovetailed or T-shaped track in the cylindrical surface of the abrasive tool.

When heating it is sufficient that at least a plasticisation of the thread is ensured. However, it will also be advantageous that at least partial plasticisation of the U profile bottom appears in order to establish an integral link of plastic from the inserted thread and plastic from the U profile.

In order to obtain an abrasive element ready for use, it is preferred, before cutting the abrasive element into desired lengths, to perform a separation of bristles and lamellae and a cut of the bristles into a length that is adapted to the length of the lamellae used.

In this manner an optimal relation between the bristles and lamellae is obtained so that a tool may be put to use as soon as the abrasive element has been inserted.

This takes place by separating bristles and abrasive lamellae, preferably by inserting a spreading member between the bristles and the lamellae so that they are conveyed in two parallel rows over a distance. In this manner cutting members may be applied to shorten the bristles so that they obtain a desired length. If desired, the abrasive lamellae may be shortened at the same time. However, this will rarely be the case since the abrasive lamellae are formed transversely of a sheet-shaped abrasive material, preferably emery cloth. By contrast, the bristles may have unequal lengths due to their being laid down.

The bristles are laid down by bristle threads being conveyed to the spread-out U profile with an orientation transversely of the U profile in such a manner that the centres of the bristles are situated approximately at the U profile. Then the centres of the bristles are pressed down into the U profile. This may take place simultaneously with laying down the adhesive member/the tread. Under this pressure the two bristle ends will project upward and will then have unequal lengths. Alternatively, the bristles may also be introduced with one end inserted into the U profile. Also in this case there will be an uncertainty as to the bristle length since the bristles may be displaced at a shorter or longer distance into the U profile.

It is preferred that during deformation the U profile is given a cross-section contour that has larger width at the bottom of the U profile. In this manner it is possible, as mentioned above, to place the profile in an undercut track. When the sweeper or the abrasive tool is rotating, the undercut track and the cross-section contour of the profile will then contribute to the appearance of a wedging effect so that the U legs are squeezed together and thus contribute to a secure retention of the sweeper bristles or the rigidifying bristles and lamellae in the element even if certain lamellae and/or bristles are not fully embedded or retained by the applied adhesive.

If an additional adhesive member is used between the U profile and the abrasive lamellae, a particularly secure retention of the abrasive lamellae may be established. Such additional adhesive member may either be placed on the lamellae before insertion into the U profile or during insertion into the U profile simultaneously with inserting the adhesive member first mentioned.

A sweeper or abrasive element according to the invention is characterised in that the profile is at least partially manufactured from plastic and is composed of a bottom and two legs projecting upward from it, said profile being flexible in the longitudinal direction according to a plan perpendicular to the U bottom, and wherein the legs are manufactured in a compressed state so that they are elastically yielding pressed towards each other, so that the profile has a substantially triangular longitudinal cross-section in an initial state, the distance between the upper ends of the U legs in a nondeformed state being shorter than the distance between the lower ends, and that the sweeper bristles or the abrasive lamellae and rigidifying bristles are retained in the U by an adhesive member in the form of plastic originating from a plastic thread between the sweeper and rigidifying bristles and from the inside of the profile, which have been heated above the plasticisation temperature so that the plastic encloses the sweeper bristles or the rigidifying bristles and abrasive lamellae and forms an integral unit.

Such a sweeper or abrasive element is advantageous because an integral unit is formed so that bristles and lamellae cannot become loose when the sweeper, abrasive or polishing tool is being used. The element is further advantageous because the plastic profile can be bent easily and consequently may be adapted to any diameter of the cylindrical surface of the sweeper, abrasive or polishing tool. Thus, the element may optionally be delivered to a user in endless lengths or cut into lengths fitting the tools of the individual user. Replacing the sweeper or abrasive element is performed easily and simply by inserting the formed U profile in an undercut track in the tool body. As the distance between the upper ends of the U legs is shorter than the distance between the lower ends, the abrasive element will, as explained above, be retained in the track.

The abrasive lamellae used will preferably be formed from an elongated abrasive cloth which is slit at one lateral edge. At the other lateral edge the lamellae are thus coherent at the part of the abrasive cloth that has not been slit. With this kind of abrasive cloth a mutual positioning of the abrasive lamellae in the abrasive element is obtained and at the same time handling the manufacture of the abrasive element is easier. Thus, the abrasive lamellae may be stored in a roll-shape and be unwound from such a roll and conveyed at a velocity corresponding to the conveyance velocity of the U-shaped profile and the adhesive member.

DESCRIPTION OF THE DRAWING

The invention will now be explained in further detail with reference to the accompanying schematic drawing, wherein

FIG. 1 illustrates an apparatus 1 for the manufacture of abrasive elements 2 by a method according to the invention.

Figure 1:
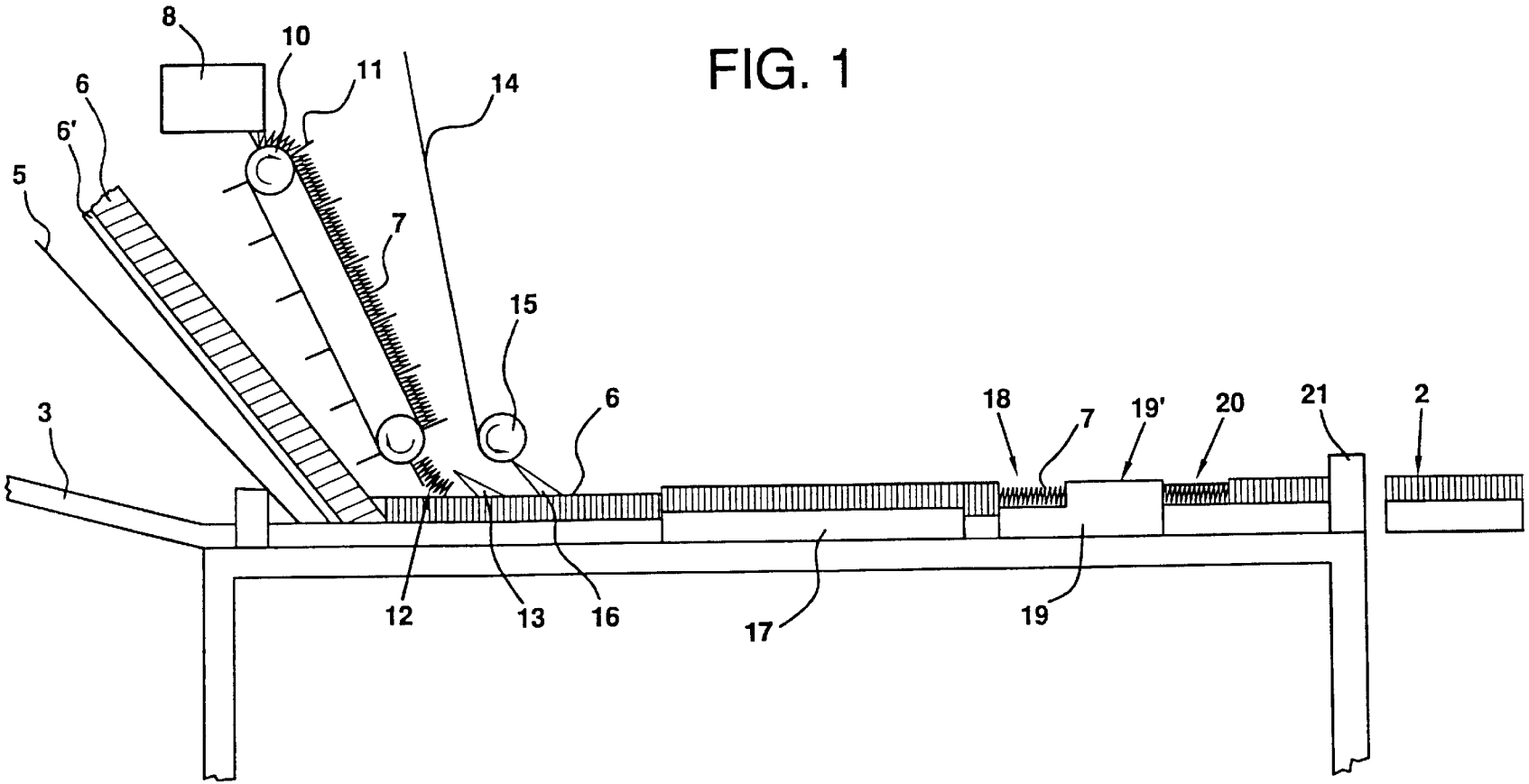
FIG. 1 illustrates a method according to the invention.

According to the method, a flexible U-shaped profile 3 is conveyed from a feeding roller (not shown). The two legs of the U-shaped profile are spread apart in a station 4. Immediately thereafter an adhesive member 5 in the form of a plastic thread or alternatively of a double-sided adhesive tape is introduced into this station. The adhesive member 5 is introduced in vicinity of one leg of the U profile and immediately next to it abrasive lamellae 6 are introduced, which will thus lie adjacent the first of the two legs of the U profile 3.

As appears from the figure, the abrasive lamellae 6 are formed by slitting a web-shaped abrasive cloth and are part of the web width. In this manner a coherent edge area 6' appears, which is introduced into the U profile 3 and which ensures a mutual retention of the abrasive lamellae 6. It is preferred for the cut of the abrasive cloth web to be performed in such a manner that during the slitting the abrasive lamellae are given a slight turn so that the abrasive side is oriented at an angle between 2° and 5° in relation to the longitudinal direction of the abrasive element.

After introducing the abrasive lamellae, rigidifying bristles 7 are arranged between the two legs of the U. The bristles 7 are conveyed from a supply source 8 where they are given a uniform orientation in a vibration device or similar device. The bristles are then transferred to an endless conveyor belt 9, which conveys the bristles 7 with an extension transverse of the U profile. The conveyor belt 9 has a direction of conveyance according to the arrow 10. Projecting walls 11 are positioned transversely of the conveyor belt 9. Between the subsequent walls 11 a number of bristles will be situated, which are laid down between the U profile legs at the point 12, a directing member 13 pressing the central part of the bristles into the bottom of the U profile. Immediately afterwards a thread-shaped adhesive member in the form of a dissoluble plastic thread 14 is introduced between the U legs. The plastic thread 14 is conveyed from a supply roll (not shown) around a roller 15 and laid down by means of a positioning member 16 corresponding to the positioning member 13. In this manner it is ensured that the plastic thread 14 is brought into folded bristles 7 and into the bottom of the U profile. Thus, the folded rigidifying bristles 7 will be positioned at the second U leg in a position alongside the abrasive lamellae 6.

It is noted that the process of introducing the bristles 7 and the plastic thread 14 may alternatively be introduced simultaneously by positioning the plastic thread in immediate vicinity of the conveyor belt so that it extends in a track between subsequent walls 11 and, thus, will keep the bristles 7 in contact with the conveyor belt and in such a manner that the plastic thread 14 will be laid down into the bottom of the U by the positioning member 14, which folds and conducts the rigidifying bristles 7 into the U bottom.

At this moment the spreading of the U profile will cease, and the U profile with the bristles, abrasive elements and plastic thread arranged therein is now conducted to a unit 17 where the upper ends of the two legs are brought towards each other in order to squeeze the lamellae and bristles. The unit 17 is provided with heating members so that a heating above the plasticisation temperature of the plastic thread 14 is performed simultaneously. The temperature will simultaneously lead to at least a partial plasticisation of the U profile so that plastic from the plastic thread and the inner side of the U profile is made to enclose the bristles 7 and the abrasive lamellae 6 for formation of an integral unit. Plastic from the plastic thread 14 and the U profile 3 will thus coalesce and form a completely integral unit, wherein the bristles 7 and the lamellae 6 are embedded and form a part. It will then not be possible to separate the different components from each other without ruining the abrasive element formed. The U profile is then cooled under the plasticisation temperature. This may preferably take place in the last half of the unit 17. Alternatively a separate cooling unit may be applied.

The elongated abrasive element thus formed is then conducted to a unit 19 in which the aligned bristles 7 and abrasive lamellae 6 are separated. The abrasive lamellae are brought aside so that the bristles 7 may be cut to a uniform length. In the figure it is shown at point 18 how the abrasive lamellae are laid down and the bristles 7 appear with non-uniform length. After passage through a cutting member 19' in the unit 19 the bristles appear with uniform length at a position 20. This cutting of the bristles 7 is advantageous for manufacturing an abrasive element 1 that is ready for use directly after it has left the manufacturing apparatus.

After the bristles 7 have been cut, the separation or spreading of the abrasive lamellae or the bristles will cease. The abrasive element may then be cut into desired lengths in a cutting unit 21. Then abrasive elements 2 in the desired length appear. Alternatively it is possible to manufacture the abrasive elements in endless lengths, which are wound onto supply rollers, which may then be delivered to the user, who may shorten the abrasive elements into the lengths he desires. Winding onto rollers is possible because the U-shaped plastic profile has sufficient flexibility to be wound.

It is noted that as an alternative to the use of a plastic profile, a U profile of rubber or other flexible material may also be used. It should only be ensured that the profile has such flexibility or compliance that it is able to adapt to different diameters when the profile is inserted into tracks on an abrasive or polishing tool.

In order to produce an abrasive element that is directly ready for use and that may easily be fastened in such a tool, the unit 17 will be designed in such a manner that during heating and subsequent cooling a static deformation of the U profile is performed so that the cross-section contour will have a larger dimension at the U bottom than at the abrasive lamellae and the bristles. Due to this the U profile may be inserted into undercut tracks, which may for example be dovetailed or T-shaped. Thus, the abrasive element thus produced may easily and quickly be inserted into existing abrasive or polishing tools, the cylinder surfaces of which are provided with tracks that have previously been designed to receive abrasive elements having a metal U profile.

Thus, the user does not need to store a large number of abrasive elements that are adapted to different diameters of the tools.

Figure 2:
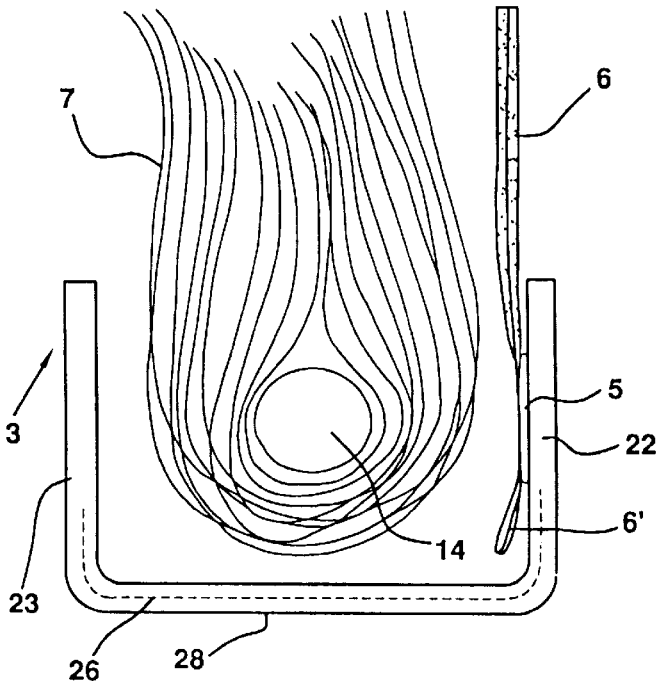
FIG. 2 shows a sectional view through an abrasive element according to the invention during manufacture.

In FIG. 2 an abrasive element is seen such as it will appear immediately after laying down the plastic thread 14 but before heating and deformation. Thus, the U will have its legs spread apart. In the condition shown the legs of the U are spread to a state in which they extend in parallel with each other. Alternatively the U legs may be spread even wider in order to create as much space as possible between the legs. It is seen that the abrasive lamellae 6 are introduced at the first leg 22 whereas the bristles 7 are introduced in vicinity of the second leg 23 of the U profile.

Figure 3:
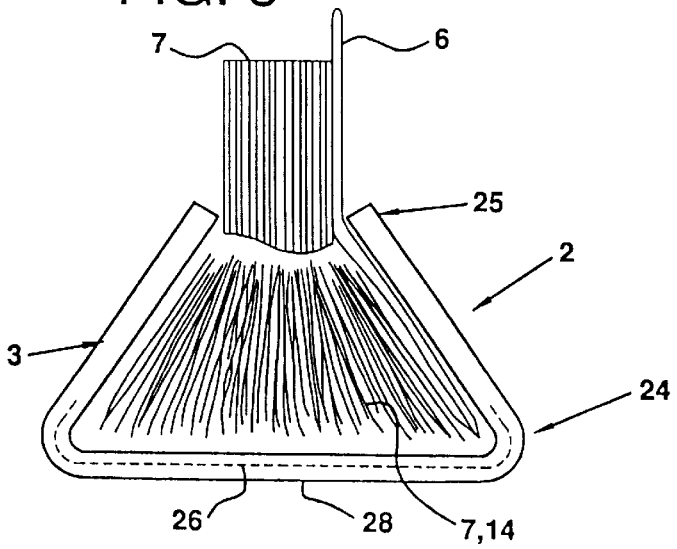
FIG. 3 shows a sectional view corresponding to FIG. 2 through the abrasive element after its manufacture has been completed.

In FIG. 3 the U profile is seen in its completed form with shortened bristles 7 and with the U profile 3 deformed into a state in which the cross-section contour has a larger dimension at the U bottom 24 than at the U top 25 at the bristles 7 and abrasive lamellae 6 projecting therefrom. It is seen here that the thread 5, the abrasive lamellae 6, the bristles 7 and the thread 14 inside the U profile form an integral unit, which may be conceived of as a plastic matrix in which part of the threads 7 and part of the abrasive lamellae 6 are embedded. It has been said above that part of the plastic of the U profile is plasticised. It is noted, however, that this is not necessary. Thus, it may be sufficient that the threads 5 and 14 are plasticised and fill out the cross section area inside the deformed U profile together with the bristles 7 and the abrasive lamellae 6. When the deformed U profile is displaced into an undercut track in an abrasive or polishing tool, the bristles 5 and the lamellae 6 will still be retained in the U profile since the integral coalesced unit filling the U profile will be retained therein as the dimensions at the top 25 of the U profile is smaller than the dimension at the bottom 24 of the U profile.

In FIGS. 2 and 3 a metal lining 26 is shown. The metal lining is optional and is used in order to contribute to establishing a squeeze around the sweeper bristles or the rigidifying bristles and abrasive lamellae in addition to the retention effect obtained due to the compression of the two legs 22, 23 of the U.

The metal lining 26 is produced with a plate-shaped part 27 designed to be placed embedded in the bottom 28 of the U-shaped profile. At either side of the plate-shaped part 27 tooth-shaped or comb-shaped projections 29 are formed, which are designed to extend partially into the legs 22, 23 of the U-shaped profile.

When an element is manufactured and the legs 22, 23 have been pressed back against the bristles/lamellae, the tooth-shaped projections 29 may be given an inwardly oriented fold so that they contribute to retaining the profile legs 22, 23 in their oblique inwardly oriented position where they squeeze the embedded bristles/abrasive lamellae. In this manner the risk of an unintended separation of the plastic profile and the bristles/abrasive lamellae positioned therein is reduced during transport, storage and handling of a sweeper or abrasive element before it is mounted in a tool.

Figure 4:
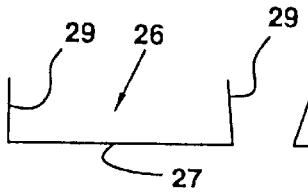
FIG. 4 shows a sectional view through a metal lining.
Figure 5:
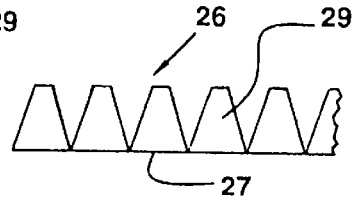
FIG. 5 shows a lateral view of the metal lining, which may be embedded in the U profile.

In FIGS. 4 and 5 a cross-section, respectively a side view of a lining 26 is seen. It is noted, however, that the tooth-shaped projections may have other shapes than the severed triangles shown. It is only important that the projections 29 have such a shape that the formed sweeper or abrasive element 2 may easily be bent in the plane perpendicular to the bottom 28 of the U-shaped profile so that the element may easily be adapted to the curve of the tool in which it is to be mounted.

The lining will preferably be produced from aluminium but other very flexible metals may also be used.

What is claimed is:

1. A method for manufacturing a sweeper or abrasive element for use in a rotating sweeper, abrasive or polishing tool comprising providing bristles or lamellae of abrasive cloth and rigidifying bristles for retention in a substantially U-shaped plastic profile, the profile having a bottom and two legs projecting from the bottom, manufacturing the profile in a compressed state wherein the legs are pressed towards each other and elastically yielding and forming the profile having a substantially triangular cross-section in an initial state, and forming the profile longitudinally flexible in a plane perpendicular to the bottom with the two legs being spaced, inserting bristles between the two legs or inserting abrasive lamellae adjacent one of the two legs and rigidifying bristles adjacent the other leg, providing an adhesive member in the profile for embedding the bristles or the rigidifying bristles and the abrasive lamellae to the bottom of the profile to form a unitary structure of the profile and bristles or the profile, rigidifying bristles, and abrasive lamellae adhered to each other, restoring the U-shaped profile back to the initial state with upper ends of the two legs approaching each other thereby squeezing and retaining the bristles or the lamellae and the rigidifying bristles and cutting the element formed into desired lengths.

2. The method of claim 1, wherein providing the adhesive member comprises providing a fusible plastic thread, and the embedding comprising fusing the profile and the thread by heating to a temperature above plasticization temperature of the thread and the profile and subsequently cooling while conducting through a matrix applying a desired contour and integrating the bristles and the profile to form the unitary structure.

3. The method of claim 2, wherein the heating comprises melting the thread by ultrasonic treatment.

4. The method of claim 2, wherein the heating comprises heating to a temperature for at least a partial plasticization of the bottom and thereby forming an integral element during the subsequent cooling.

5. The method of claim 1, further comprising separating the rigidifying bristles and the abrasive lamellae and cutting the rigidifying brushes to a predetermined length as a length of the abrasive lamellae.

6. The method of claim 1, further comprising providing a plate metal lining in the bottom of the profile, and providing the lining with tooth-shaped projections at edges extending partially into to the legs of the profile.

7. The method of claim 6, further comprising providing an additional adhesive member between the profile and the abrasive lamellae as a fusible plastic thread.

8. The method of claim 7, wherein the additional adhesive member is positioned on the abrasive lamellae before being placed in the U-shaped profile.

9. An element for use in a rotating sweeper, abrasive or polishing tool comprising bristles or lamellae of abrasive cloth and rigidifying bristles, a substantially U-shaped profile for retaining the bristles or the rigidifying bristles and the cloth, the profile being made partially of plastic material, a bottom and two legs forming the profile, the profile being flexible in a longitudinal direction in a plane perpendicular to the bottom, and wherein the legs are elastically yielding and pressed towards each other, the profile having a substantially triangular cross-section in an initial state, the distance between ends of the U legs in a non-deformed state being shorter than a distance at the bottom, an adhesive member for embedding the sweeper bristles or the abrasive lamellae and rigidifying bristles in the bottom, wherein the adhesive member is a plastic thread with the bristles and the profile, and plastic melt encompassing the bristles after heating above a plasticization temperature thereby forming a unitary element of the profile and bristles or the profile, rigidifying bristles, and abrasive cloth adhered to each other by the adhesive member.

10. The element of claim 9, wherein the abrasive lamellae comprises elongated abrasive cloth having slits forming the abrasive lamellae extending transversely of a longitudinal direction of the profile.

* * * * *